United States Patent [19]

Okada

[11] 4,181,183

[45] Jan. 1, 1980

[54] IMPACT TOOL

[75] Inventor: Hiroshi Okada, Suita, Japan

[73] Assignee: Nippon Pneumatic Manufacturing Co., Ltd., Osaka, Japan

[21] Appl. No.: 867,174

[22] Filed: Jan. 5, 1978

[51] Int. Cl.[2] ..... B25D 9/00

[52] U.S. Cl. ..... 173/119; 91/300; 173/134; 173/DIG. 4

[58] Field of Search ..... 173/134, 135, 137, 139, 173/DIG. 4, 119; 91/300

[56] References Cited

U.S. PATENT DOCUMENTS

| | | | |
|---|---|---|---|
| 3,213,615 | 10/1965 | Bjornberg | 173/134 |
| 3,411,592 | 11/1968 | Montabert | 173/137 |
| 3,766,830 | 10/1973 | Montabert | 91/300 X |
| 3,827,507 | 8/1974 | Lance | 173/119 |
| 3,866,690 | 2/1975 | Lance et al. | 173/15 |
| 3,916,764 | 11/1975 | Crover | 91/235 |
| 3,955,478 | 5/1976 | Feucht | 92/85 B |
| 4,039,033 | 8/1977 | Salmi | 173/DIG. 4 |

*Primary Examiner*—Lawrence J. Staab
*Attorney, Agent, or Firm*—Wenderoth, Lind & Ponack

[57] ABSTRACT

An improved impact tool which has a cylinder, a liner mounted therein, a piston mounted in the liner and reciprocated by gas and hydraulic pressure, and a tubular valve slidably mounted on the liner for controlling a hydraulic circuit. The tubular valve is hydraulically pushed up and down without a spring being used. No gas accumulator is used. Thus, the impact tool has a simple construction and is durable.

2 Claims, 3 Drawing Figures

IMPACT TOOL

The present invention relates to an impact tool having a piston reciprocated under hydraulic and gas pressure for hitting a chisel or like tool.

An impact tool is known which includes a cylinder, a linear mounted therein, a piston mounted in said liner and reciprocated under hydraulic and gas pressure to hit a chisel or the like, a tubular valve for controlling a hydraulic circuit slidably mounted on said liner and pushed up hydraulically against the bias of a spring, and a gas accumulator disposed above the cylinder.

Such a conventional impact tool is subject to failure due to poor bias or breakage of the spring serving to push the tubular valve down. Also it has a complicated construction due to the provision of the gas accumulator.

An object of this invention is to provide an impact tool which is less liable to failure and has a greater durability.

Another object of this invention is to provide an impact tool which is simpler in design and is more inexpensive to manufacture.

Other features and advantages of this invention will become apparent from the following description taken with reference to the accompanying drawings, in which.

Figure 1:
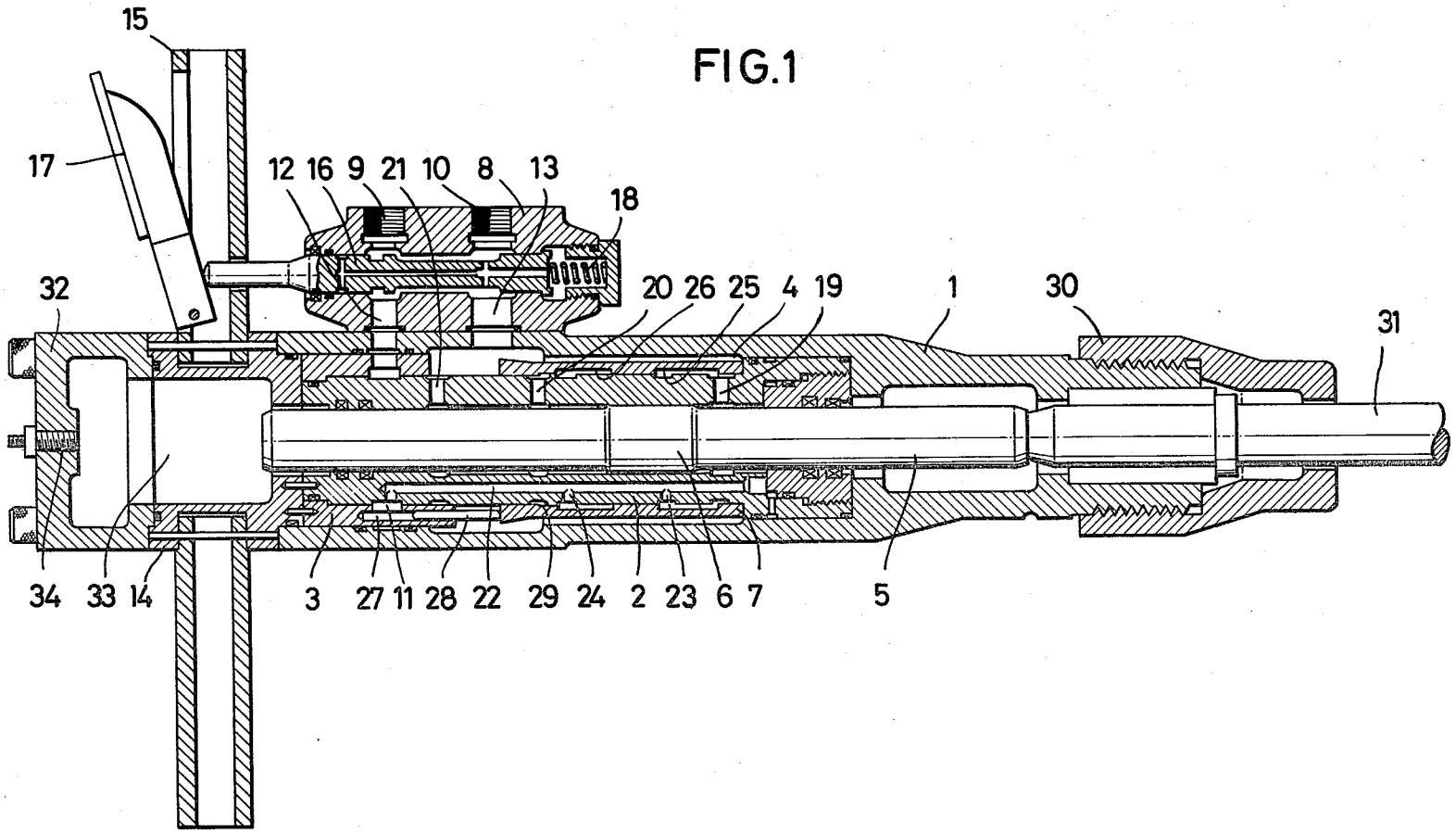
FIG. 1 is a vertical sectional view of an embodiment of the present invention.

Referring to FIG. 1, the tool has a cylinder 1 in which a liner 2 is fixedly mounted with an annular space 4 between the cylinder 1 and liner 2. Another liner 3 is mounted on the top portion of liner 2. A piston 5 having an enlarged portion 6 midway of its length is slidably mounted in the liner 2. A tubular valve 7 is slidably mounted on the liner 2 in the annular space 4.

A valve housing 8 is fixed to the side of the cylinder 1. It has an oil inlet 9 to be connected with a hydraulic oil supply unit, an oil outlet 10 to which an oil discharge pipe is connected, an oil supply port 12 communicating with an annular space 11 formed between the liners 2 and 3, an an oil discharge port 13 communicating with the annular space 4, all of the ports being open to a bore in the valve housing 8.

A handle 15 is secured to a handle mounting member 14 secured to the top of the cylinder 1. On the handle 15 is pivoted a lever 17 used to operate a valve body 16 slidably mounted in the bore in the valve housing 8. The valve body 16 is urged by a spring 18 toward the lever 17 to a position in which the oil inlet 9 normally communicates with the oil outlet 10 through the valve housing bore. When the lever 17 is pressed down to lower the valve body 16 against the bias of the spring 18, the oil outlet 10 is blocked off from the oil inlet 9.

The liner 2 has radial ports 19, 20 and 21 therein spaced in the direction from the bottom to the top of the tool, said ports having an annular enlargement at each end thereof. The liner 2 also has a passage 22 therein parallel to the axis of the liner and connecting the annular space 11 and two radial ports 23 and 24 branching outwardly from the axial passage 22. The tubular valve 7 has in its inner surface an annular recess 25 connecting the radial ports 19 and 23 when valve 7 is in its lower position, and has an annular recess 26 connecting the radial ports 20 and 24 when valve 7 is in its upper position.

The liner 3 has a plurality of axial holes 27 extending from the bottom thereof to the annular space 11. In each axial hole is mounted a rod 28 with the lower end bearing on the tubular valve 7. The liner 2 has a slightly reduced outer diameter above the radial port 20 and accordingly the tubular valve 7 has on its inner surface a shoulder 29 slidably fitted on the reduced diameter portion of the liner 2. This arrangement is provided to ensure that the cross sectional area of the portion of the tubular valve 7 at the shoulder 29 which is effective to receive hydraulic oil pressure is larger than the total cross sectional areas of the rods 28 which are effective to receive hydraulic oil pressure.

A holder 30 for an impact tool is screwed on the lower end of the cylinder 1 and holds an impact tool such as a chisel 31. Also, a head 32 is secured to the top of the handle mounting member 14. The head 32 and the member 14 form a gas reservoir 33 into which compressed air or nitrogen gas is supplied through a gas supply port 34 provided with a check valve.

In operation, the impact tool according to this invention is used for applying an impact tool, such as the chisel 31, to a workpiece. While the operating lever 17 is in its normal position, hydraulic oil flows from the oil inlet 9 into the valve housing 8, but returns to the tank through the oil outlet 10. Thus, no hydraulic pressure is applied to the cylinder 1 so that the piston 5 remains in its lower position.

When the lever 17 is pressed down to lower the valve body 16 against the action of the spring 18 this blocks off the oil inlet 9 from the outlet 10, hydraulic oil flows through the oil supply port 12, annular space 11, axial passage 22, radial port 23, annular recess 25, radial port 19 and into a lower chamber formed between the liner 2 and the piston 5 below the enlarged portion 6, applying pressure to the portion 6. Pressure is also applied to the tops of the rods 28.

Since an upper chamber formed between the liner 2 and the piston 5 above the enlarged portion 6 communicates with the oil discharge port 13 through the radial port 21, the piston 5 is pushed up by hydraulic pressure acting on the enlarged portion 6. When the bottom of the enlarged portion 6 rises above the radial port 20, part of the oil flows into the port 20, acting on the shoulder 29 thereunder.

Since as mentioned before the cross sectional area of the tubular valve 7 at the shoulder 29 is designed to be larger than the total cross sectional areas of the rods 28, the tubular valve 7 rises against the hydraulic pressure applied by the rods 28 so that the radial port 20 communicates with the radial port 24 through the annular recess 26. As soon as the tubular valve 7 moves up, the hydraulic oil in the lower chamber is allowed to flow through the radial port 19 and the annular space 4 into the upper chamber where the drop of the piston which will be described below leaves some additional space for hydraulic oil.

On the other hand, since the gas in the gas reservoir 33 is compressed by the rising piston 5, the latter is forced downwardly rapidly by the reaction of the compressed gas, hitting the chisel 31, as soom as the hydraulic pressure acting on the bottom of the enlarged portion 6 drops. When the enlarged portion 6 moved below the radial port 20, the upper chamber between the liner 2 and the piston connects the radial ports 20 and 21 with each other so that hydraulic pressure does not act on the shoulder 29 any more. This allows the rods 28 to press the tubular valve 7 down to its original lowermost position. Then, the cycle described above starts again.

As long as the lever 17 is kept pressed down to lower the valve body 16, the cycle described above is repeated so that the piston 5 reciprocates, hitting the chisel 31 repeatedly. When lever 17 is released, the valve body 16 moves up due to the bias of the spring 18 to connect the oil inlet 9 with the oil outlet 10 so that the piston 5 stops.

It will be understood from the foregoing that the impact tool according to this invention is less liable to failure and has a longer working life since no spring is used to urge the tubular valve 7 downwardly. Also, it has a simpler construction and is less expensive to manufacture since no gas accumulator is needed.

Although this invention has been described with reference to an embodiment having a valve housing 8 and a handle 15 mounted on the impact tool itself, these control units may be mounted e.g. on an excavating machine such as a backhoe or a power shovel and be connected with the impact tool through flexible hoses for supplying and discharging hydraulic oil. In such a case, the impact tool without a handle or a valve housing may be mounted on the tip of the arms of such an excavator.

Figure 2:
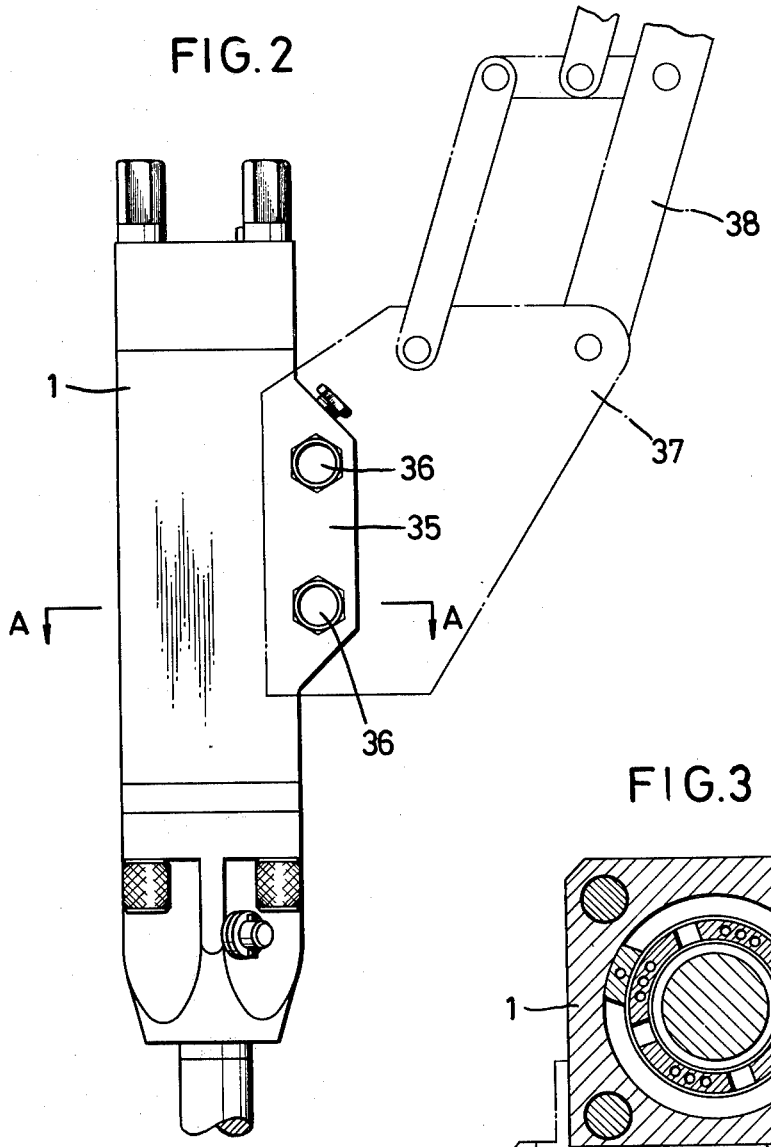
FIG. 2 is an elevation view of another embodiment having no handle or valve box attached, showing the manner in which it is mounted e.g. on an excavator.
Figure 3:
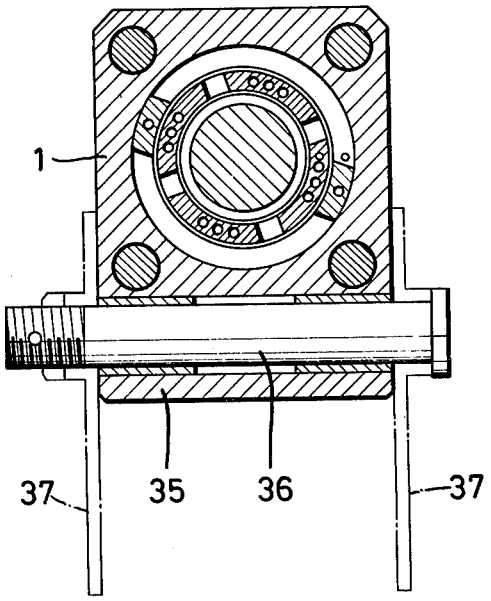
FIG. 3 is a sectional view of the embodiment of FIG. 2 taken along the line A—A of FIG. 2.

FIGS. 2 and 3 show such an arrangement in which the cylinder 1 has a projecting portion 35 on which the impact tool is mounted by two bolts 36 between two mounting plates 37 secured to arms 38 extending from an excavator.

While a preferred embodiment has been described, various changes or variations can be made without departing from the scope of this invention.

What is claimed is:

1. An impact tool comprising:

a cylinder;

a liner mounted therein with an annular space between said liner and said cylinder;

a piston reciprocably mounted in said liner and having an enlarged portion substantially midway of its length sealingly slidable in said liner and defining spaces in said liner above and below said piston;

a tool holder secured to the bottom of said cylinder for holding therein a tool to be hit by said piston upon the downward stroke of said piston;

said liner having a plurality of oil apertures therein between the interior of said liner and said annular space and spaced along the length of said liner for flow of hydraulic oil between said annular space and the spaces in said liner above and below said enlarged portion of said piston, and said cylinder having an outlet opening out of said annular space;

a tubular valve slidably mounted on said liner in said annular space for controlling the flow of hydraulic oil through said oil apertures into the space below said enlarged portion for pushing the piston up when said valve is in a lower position and for allowing the oil in said lastmentioned space to be discharged from the lastmentioned space when said valve is in an upper position and having a portion with an effective cross-sectional area exposed to hydraulic oil under pressure through one of said oil apertures when said piston is in the raised position for raising said tubular valve, said portion no longer being exposed to the hydraulic oil under pressure when said enlarged portion of said piston passes said one oil aperture on its downstroke;

at least one rod slidably mounted on the cylinder for movement substantially parallel to said piston and extending into said annular space and having one end engaging said tubular valve;

a gas reservoir provided above the cylinder for containing gas for being compressed as said piston moves up; and a hydraulic circuit in said cylinder and said liner for supplying hydraulic oil to said liner for flow through said oil apertures and to the other end of said rod against an effective cross-sectional area of said rod which is less than said effective cross-sectional area of said portion of tubular valve member for biasing said rod and said tubular valve down under hydraulic pressure when the tubular valve is in the upper position.

2. An impact tool as claimed in claim 1 in which said cylinder has a second liner mounted on said firstmentioned liner around the top thereof and having at least one hold therein parallel to the axis thereof which said rod is slidably mounted.

* * * * *